US008222190B2

(12) United States Patent
Zhamu et al.

(10) Patent No.: US 8,222,190 B2
(45) Date of Patent: Jul. 17, 2012

(54) NANO GRAPHENE-MODIFIED LUBRICANT

(75) Inventors: Aruna Zhamu, Centerville, OH (US); Bor Z. Jang, Centerville, OH (US)

(73) Assignee: Nanotek Instruments, Inc., Dayton, OH (US)

( * ) Notice: Subject to any disclaimer, the term of this patent is extended or adjusted under 35 U.S.C. 154(b) by 287 days.

(21) Appl. No.: 12/583,320

(22) Filed: Aug. 19, 2009

(65) Prior Publication Data

US 2011/0046027 A1 Feb. 24, 2011

(51) Int. Cl.
*C10M 169/04* (2006.01)

(52) U.S. Cl. ..... 508/113

(58) Field of Classification Search ..... 508/113
See application file for complete search history.

(56) References Cited

U.S. PATENT DOCUMENTS

| | | | | |
|---|---|---|---|---|
| 2,798,878 | A | 7/1957 | Hummers | |
| 6,419,717 | B2 | 7/2002 | Moy et al. | |
| 6,783,746 | B1 | 8/2004 | Zhang | |
| 6,828,282 | B2 | 12/2004 | Moy et al. | |
| 7,071,258 | B1 | 7/2006 | Jang et al. | |
| 7,348,298 | B2 | 3/2008 | Zhang | |
| 2007/0158609 | A1 * | 7/2007 | Hong et al. | 252/71 |
| 2008/0302998 | A1 | 12/2008 | Hong | |
| 2009/0033164 | A1 | 2/2009 | Khan | |

OTHER PUBLICATIONS

U.S. Appl. No. 11/800,728, filed May 8, 2007, A. Zhamu, et al.
C. Lee, et al., "Measurement of the Elastic Properties and Intrinsic Strength of Monolayer Graphene," Science, 321 (Jul. 2008) 385-388.
A. Balandin, et al. "Superior Thermal Conductivity of Single-Layer Graphene," Nano Lett., 8 (3) (2008) 902-907.
Bor Z. Jang and A Zhamu, "Processing of Nano Graphene Platelets (NGPs) and NGP Nanocomposites: A Review," J. Materials Sci. 43 (2008) 5092-5101.

* cited by examiner

*Primary Examiner* — James Goloboy
*Assistant Examiner* — Taiwo Oladapo

(57) ABSTRACT

A lubricant composition having improved lubricant properties, comprising: (a) a lubricating fluid; and (b) nano graphene platelets (NGPs) dispersed in the fluid, wherein nano graphene platelets have a proportion of 0.001% to 60% by weight based on the total weight of the fluid and the graphene platelets combined. Preferably, the composition comprises at least a single-layer graphene sheet. Preferably, the lubricating fluid contains a petroleum oil or synthetic oil and a dispersant or surfactant. With the addition of a thickener or a desired amount of NGPs, the lubricant becomes a grease composition. Compared with graphite nano particle- or carbon nanotube-modified lubricants, NGP-modified lubricants have much better thermal conductivity, friction-reducing capability, anti-wear performance, and viscosity stability.

35 Claims, 3 Drawing Sheets

NANO GRAPHENE-MODIFIED LUBRICANT

The present invention is a result of a research and development project sponsored by the US National Science Foundation Small Business Technology Transfer (STTR) Program.

FIELD OF THE INVENTION

The present invention relates generally to the field of lubricant or grease. In particular, the invention provides a lubricant or grease modified by nano graphene platelets (NGPs), also known as graphene nano sheets or graphene nano ribbons. The NGPs include pristine graphene that is substantially free from oxygen, as well as the oxidized graphene, also known as graphite oxide nano platelets.

BACKGROUND OF THE INVENTION

Lubricants and greases of various types are used in equipment and in manufacturing processes to reduce friction and wear and, in many situations, remove waste heat. Although some lubricants are water-based, most of the lubricants are oil-based, containing, for instance, mineral oil, poly (alpha olefin) oil, ester synthetic oil, ethylene oxide/propylene oxide synthetic oil, polyalkylene glycol synthetic oil, and silicone oil.

The main technical requirements for lubricants are that they must be able to: (a) keep surfaces of working parts separate under all loads, temperatures and speeds, thus minimizing friction and wear; (b) act as a cooling fluid removing the heat produced by friction or from external sources; (c) remain adequately stable in order to guarantee constant behavior over the forecasted useful life; (d) protect surfaces from the attack of aggressive products formed during operation; and (e) fulfill detersive and dispersive functions in order to remove residue and debris that may form during operation. The main properties of lubricants, which are usually indicated in the technical characteristics of the product, are viscosity, viscosity index, pour point, and flash point. However, more and more machinery operation environments demand an effective heat management strategy, typically requiring the use of a lubricant with a high thermal conductivity. The thermal conductivity values of the commonly used lubricating oils (without an additive) are typically in the range of 0.1 to 0.17 W/m-K at room temperature and thus they are not good heat transfer agents.

In order to meet the various requirements, one or more types of additives or property modifiers are added into the neat fluid (e.g. base oil) in a lubricant or grease composition. The neat fluid, with or without a dispersant, is herein referred to as the lubricating fluid in a lubricant or grease composition. The use of graphite particles in lubricants or greases is well known in the art. Graphite is added as a friction reducing agent, which also carries some of the load imposed on the working fluid, thereby helping to reduce surface damage to working parts. Although the thermal conductivity of graphite is much higher than that of essentially all base oils and water, few patents filed on graphite-containing lubricants specifically rely on graphite to improve the thermal conductivity of the fluid. While graphite-containing automotive engine oil was once commercialized (ARCO graphite), the potential to use graphite as a heat transfer-enhancing agent in this oil was not realized. The particle size of graphite used was typically very large, on the order of one to several microns. As a result, the graphite incorporated in the automotive engine oil had strong tendency to settle in the fluid.

Graphite particles of this size have been used to reduce friction and improve wear performance of certain fluids, e.g. in metalworking fluids. However, the use of graphite in lubricants for re-circulating systems has been decreasing, partly due to the concern that graphite could pile up in restricted flow areas in concentrated contacts, thereby leading to lubricant starvation in other areas of the system. The effect of graphite particle size on these phenomena was studied by Zhang et al who taught about utilizing nano-sized graphite particles with the mean particle size less than 500 nm to enhance thermal conductivity in fluids, but failed to disclose how these fine graphite particles performed other desired functions (e.g. wear resistance). The patent of Zhang et al. "Enhancing thermal conductivity of fluids with graphite nanoparticles and carbon nanotube," U.S. Pat. No. 7,348,298, Mar. 25, 2008, is herein incorporated as a reference. In Zhang's patent, graphite nano particles were prepared by grinding and ball-milling carbon foam particles down to a diameter <1 μm, more typically <500 nm.

Nanoparticles as Additives for Lubricants or Greases

Nanoparticles are considered well suited for tribological applications since lubrication takes place at the nanoscale level. To achieve boundary lubrication, for instance, certain molecules can form a thin carpet with the thickness of just one or two molecules to separate the surface asperities. For anti-wear lubrication, molecules can chemically attach to the metal surface, forming a thin barrier film. In extreme pressure lubrication, molecules can react chemically with the metal surface, forming a sacrificial film of metallic salts to prevent catastrophic wear.

Nanoparticles can meet these needs because they have a high surface affinity and chemical reactivity and their small sizes enable them to penetrate wear crevices. Nanoparticles are emerging as additive components in industrial lubricants, such as greases, dry film lubricants, and forging lubricants. Several types of nanoparticles have been studied as potential lubrication oil additives, including metal oxides of silicon, titanium and zinc; fluorides of metals such as cerium, lanthanum and calcium; and zinc-, copper- and lead sulfides. Neat metals, such as nickel, zinc, and copper, molybdenum compounds, and carbon nanotubes also have been considered.

Some of these nano particles were selected based on traditional bulk lubricating materials, which typically contain sulfur, chlorine, and phosphorus. However, titanium, nickel, and silicon are considered abrasive materials in their bulk form, with particle sizes between 3 to 10 microns, but have exhibited lubricating properties in the nanoscale range (less than 100 nanometers).

Although some progress has been made in nanoparticle lubrication technology, tribological mechanisms involving the utilization of nanoparticles remain poorly understood. It is generally postulated that rigid spherical and cylindrical nanoparticles (graphite nano particles and carbon nanotubes, respectively) protect metal surfaces under low loads and slow speeds from wear by rolling actions—i.e. they act as miniature ball bearings. At higher loads and speeds, the particles were hoped to form a protective film, but they fell short in the intended lubricating functions. I particular, excessively high wear rates and friction failures remain to be challenging issues for lubricants containing graphite nano particles and carbon nanotubes.

Carbon Nanotubes (CNTs)

One major development in the field of fillers or additives in the past two decades is the carbon nanotube (CNT), which has a broad range of nanotechnology applications. Several attempts have been made to utilize CNTs as fillers in lubricants, greases, and thermal transfer fluids. CNTs were observed to improve the viscosity, thermal conductivity, and anti-wear performance of these fluids under low load and low speed conditions. Representative reports on the utilization of CNTs in lubricants include:

1. D. Moy, et al, "Carbon Nanotubes in Fuels," U.S. Pat. No. 6,419,717 (Jul. 16, 2002).
2. D. Moy, et al, "Lubricants Containing Carbon Nanotubes," U.S. Pat. No. 6,828,282 (Dec. 7, 2004).
3. Z. Zhang, et al., "Preparation of Stable Nanotube Dispersions in Liquids," U.S. Pat. No. 6,783,746 (Aug. 31, 2004).
4. Z. Zhang, et al, "Enhancing Thermal Conductivity of Fluids with Graphite Nanoparticles and Carbon Nanotubes," U.S. Pat. No. 7,348,298 (Mar. 25, 2008).
5. H. Hong, et al., "Carbon Nanoparticle-Containing Lubricant and Grease," US Publication No. 2007/0158609 (Jul. 12, 2007).
6. H. Hong, et al., "Carbon Nanoparticle-Containing Hydrophilic Nanofluid with Enhanced Thermal Conductivity," US Publication No. 2008/0302998 (Dec. 11, 2008).
7. R. U. Khan, "Wear Reduction in FDB by Enhancing Lubricants with Nanoparticles," US Publication No. 2009/0033164 (Feb. 5, 2009).

However, attempts to produce CNTs in large quantities have been fraught with overwhelming challenges due to poor yield and costly fabrication and purification processes. Hence, even the moderately priced multi-walled CNTs remain too expensive to be used in high-volume applications or commodity products, such as polymer composites, lubricants (including grease), and inks. Further, for many applications, homogeneous dispersion of CNTs in a fluid and processing of fluids containing a high CNT concentration have been difficult due to the tendency for CNTs to aggregate or physically entangle with one another and the chemical inertness of CNT surfaces.

Nano Graphene Platelets (NGPs)

Instead of trying to develop lower-cost processes for CNTs, the applicants sought to develop an alternative nanoscale carbon material with comparable properties that can be produced much more cost-effectively and in larger quantities. This development work led to the discovery of processes and compositions for a new class of nano material now commonly referred to as nano graphene platelets (NGPs), graphene nano sheets, or graphene nano ribbons [e.g., B. Z. Jang and W. C. Huang, "Nano-scaled graphene plates," U.S. Pat. No. 7,071,258, Jul. 4, 2006].

An NGP is a platelet, sheet, or ribbon composed of one or multiple layers of graphene plane, with a thickness that can be as small as 0.34 m (one carbon atom thick). A single-layer graphene is composed of carbon atoms forming a 2-D hexagonal lattice through strong in-plane covalent bonds. In a multi-layer NGP, several graphene planes are weakly bonded together through van der Waals forces in the thickness-direction. Multi-layer NGPs can have a thickness up to 100 nm, but typically less than 10 nm in the present application. Conceptually, an NGP may be viewed as a flattened sheet of a carbon nano-tube (CNT), with a single-layer graphene corresponding to a single-wall CNT and a multi-layer graphene corresponding to a multi-wall CNT. However, this very difference in geometry also makes electronic structure and related physical and chemical properties very different between NGP and CNT. It is now commonly recognized in the field of nanotechnology that NGP and CNT are two different and distinct classes of materials. Both NGPs and CNTa are also distinct from the conventional graphite nanoparticles.

NGPs are predicted to have a range of unusual physical, chemical, and mechanical properties and several unique properties have been observed. For instance, single-layer graphene (also referred to as single-sheet NGP) was found to exhibit the highest intrinsic strength and highest thermal conductivity of all existing materials, even higher than those of single-walled CNTs [C. Lee, et al., "Measurement of the Elastic Properties and Intrinsic Strength of Monolayer Graphene," Science, 321 (July 2008) 385-388; A. Balandin, et al. "Superior Thermal Conductivity of Single-Layer Graphene," *Nano Lett.,* 8 (3) (2008) 902-907]. Single-sheet NGPs possess twice the specific surface areas compared with single-walled CNTs. The thermal conductivity of single-layer graphene, as high as 5,300 W/mk, is two times higher than the highest thermal conductivity of single-walled CNTs ever reported based on actual experimental measurements. Such a high thermal conductivity could translate into a great heat-dissipating capacity if NGPs are properly dispersed in a lubricant or grease material.

In addition to single-layer graphene, multiple-layer graphene platelets also exhibit unique and useful behaviors. Single-layer and multiple-layer graphene are herein collectively referred to as NGPs. Graphene platelets may be oxidized to various extents during their preparation procedures, resulting in graphite oxide or graphene oxide (GO) platelets. In the present context, NGPs refer to both "pristine graphene" containing essentially no oxygen (<0.05% by weight of oxygen) and "GO nano platelets" of various oxygen contents. It is helpful to herein describe how NGPs are produced.

The processes that have been used to prepare NGPs were recently reviewed by the applicants [Bor Z. Jang and A Zhamu, "Processing of Nano Graphene Platelets (NGPs) and NGP Nanocomposites: A Review," *J. Materials Sci.* 43 (2008) 5092-5101]. As illustrated in FIG. 1, the most commonly used process entails treating a natural graphite powder (referred to as Product (A) in FIG. 1) with an intercalant and an oxidant (e.g., concentrated sulfuric acid and nitric acid, respectively) to obtain a graphite intercalation compound (GIC) or, actually, graphite oxide (GO) (referred to as Product (B) in FIG. 1). Prior to intercalation or oxidation, graphite has an inter-graphene plane spacing of approximately 0.335 nm ($L_d$=$d_{002}$=0.335 nm or 3.35 Å, based on X-ray diffraction data readily available in open literature). There is a misconception in the scientific community that van der Waals forces are weak forces, which needs some qualifications. It is well-known that van der Waals forces are short range forces, but can be extremely strong in magnitude if the separation between two objects (e.g., two atoms or molecules) is very small, say <0.4 nm. However, the magnitude of van der Waals forces drops precipitously when the separation increases even only slightly. Since the inter-graphene plane distance in un-intercalated and un-oxidized graphite crystal is small (<0.34 nm), the inter-graphene bonds (van der Waals forces) are actually very strong.

With an intercalation or oxidation treatment, the inter-graphene spacing is increased to a value typically greater than 0.55-0.65 nm. This is the first expansion stage experienced by the graphite material. The van der Waals forces are now significantly weakened due to the increased spacing. It is important to note that, in most cases, some of the graphene layers in a GIC are intercalated (with inter-graphene spacing increased to 0.55-0.65 nm and van der Waals forces weakened), but other layers could remain un-intercalated or incompletely intercalated (with inter-graphene spacing remaining approximately 0.34 nm and van der Waals forces staying strong).

In the conventional processes, the obtained GIC or GO, dispersed in the intercalant solution, will need to be rinsed for several cycles and then dried to obtain GIC or GO powders. These dried powders, commonly referred to as expandable graphite, are then subjected to further expansion or second expansion (often referred to as exfoliation) typically using a thermal shock exposure approach (at a temperature from 650° C. to 1,100° C.). The acid molecules residing in the inter-graphene spacing are decomposed at such a high temperature, generating volatile gas molecules that could push apart graphene planes. The inter-flake distance between two loosely connected flakes or platelets is now increased to the range of typically >20 nm to several μm (hence, very weak van der Waals forces).

Unfortunately, typically a significant proportion of the gaseous molecules escape without contributing to exfoliation of graphite flakes. Further, those un-intercalated and incompletely intercalated graphite layers remain intact (still having an inter-graphene spacing of approximately <0.34 nm). Additionally, many of the exfoliated flakes re-stack together by re-forming van der Waals forces if they could not be rapidly separated. These effects during this exfoliation step led to the formation of exfoliated graphite (referred to as Product (C) in FIG. 1), which is commonly referred to as "graphite worm" in the industry.

The exfoliated graphite or graphite worm is characterized by having networks of interconnected (un-separated) flakes which are typically >50 nm thick (often >100 nm thick). These individual flakes are each composed of hundreds of layers with inter-layer spacing of approximately 0.34 nm (not 0.6 nm), as evidenced by the X-ray diffraction data readily available in the open literature. In other words, these flakes, if separated, are individual graphite particles, rather than graphite intercalation compound (GIC) particles. This thermal shock procedure can produce some isolated graphite flakes or graphene sheets, but normally the majority of graphite flakes remain interconnected. Again, the inter-flake distance between two loosely connected flakes or platelets is now increased to from 20 nm to several μm and, hence, the van der Waals forces that hold them together are now very weak, enabling easy separation by mechanical shearing or ultrasonication.

Typically, the exfoliated graphite or graphite worm is then subjected to a flake separation treatment using air milling, mechanical shearing, or ultrasonication in a liquid (e.g., water). Hence, a conventional process basically entails three distinct procedures: first expansion (oxidation or intercalation), further expansion (so called "exfoliation"), and separation. The resulting NGPs are graphene oxide (GO), rather than pristine graphene.

In the conventional processes, the post-exfoliation ultrasonication procedure was meant to break up graphite worms (i.e., to separate those already largely expanded/exfoliated flakes that are only loosely connected). Specifically, it is important to emphasize the fact that, in the prior art processes, ultrasonification is used after intercalation and oxidation of graphite (i.e., after first expansion) and most typically after thermal shock exposure of the resulting GIC or GO (i.e., after second expansion or exfoliation) to aid in breaking up those graphite worms. There are already much larger spacings between flakes after intercalation and/or exfoliation (hence, making it possible to easily separate flakes by ultrasonic waves). This ultrasonication was not perceived to be capable of separating those un-intercalated/un-oxidized layers where the inter-graphene spacing remains <0.34 nm and the van der Waals forces remain strong.

The applicant's research group was the very first in the world to surprisingly observe that, under proper conditions (e.g., with the assistance of a surfactant and using a higher sonic power), ultrasonication is capable of producing ultra-thin, pristine graphene directly from pristine graphite, without having to go through chemical intercalation or oxidation. This invention was reported in a patent application [A. Zhamu, J. Shi, J. Guo, and Bor Z. Jang, "Method of Producing Exfoliated Graphite, Flexible Graphite, and Nano Graphene Plates," Pending, U.S. patent Ser. No. 11/800,728 (May 8, 2007)]. Schematically shown in FIG. 2 are the essential procedures used to produce single-layer or few-layer graphene using this direct ultrasonication process. This innovative process involves simply dispersing pristine graphite powder particles in a liquid medium (e.g., water, alcohol, or acetone) containing a dispersing agent or surfactant to obtain a suspension. The suspension is then subjected to an ultrasonication treatment, typically at a temperature between 0° C. and 100° C. for 10-120 minutes. No chemical intercalation or oxidation is required of the starting material prior to ultrasonication. The graphite material has never been exposed to any obnoxious chemical throughout the entire nano graphene production process. This process combines expansion, exfoliation, and separation of pristine graphitic material into one step. Hence, this simple yet elegant method obviates the need to expose graphite to a high-temperature, or chemical oxidizing environment. The resulting NGPs are essentially pristine graphene, which is highly conductive both electrically and thermally.

Different Types of Carbon Nano Materials

In the scientific community and in nano materials industry, NGPs are considered a new class of nano materials that is different and distinct from fullerene, carbon nanotubes (CNTs), and graphite nanoparticles primarily for the following reasons:

(a) Fullerene is considered a zero-dimensional carbon nano material due to its ultra-small sizes in all directions.

(b) CNTs are considered a type of one-dimensional carbon nano material due to their large size in one dimension (length), but small size in other two dimensions (cylindrical cross-section with a diameter <100 nm, more typically <30 nm, and, for single-walled CNTs, <2.0 nm).

(c) Graphite particles (including both micron-scaled and nano-scaled) are considered a three-dimensional carbon material since they have substantially identical or similar sizes in all three directions (X-, Y-, and Z-coordinates). Most of the conventional graphite nanoparticles are close to being spherical or ellipsoidal in shape having a diameter less than 500 nm, but typically >350 nm. Graphite nano particles are produced simply by pulverizing or grinding and then ball-milling natural graphite particles from typically greater than 100 μm to sub-micron in diameter (typically <500 nm, but >>100 nm). In real practice, it is difficult to grind and mill graphite particles down to a size smaller than 350 nm.

(d) NGPs are considered a two-dimensional carbon nano material with large sizes in two dimensions (both length and width typically >0.5 μm, but more typically >1 μm) and ultra-small in one dimension (thickness as small as one carbon atom size).

Due to these differences in geometry, these four classes of carbon materials also exhibit vastly different properties. For instance, the graphite nano particles were normally viewed as excellent thermally conducting materials with a high thermal conductivity of up to 60-80 W/m-k. However, this conductivity value range is almost two orders of magnitude lower than the thermal conductivity of NGPs, just recently found to be as high as 5,300 W/m-k.

In order for NGPs (either pristine graphene or graphene oxide) to be an effective nano-filler for a lubricant or grease composition, NGPs must be able to form a stable, uniform dispersion in a lubricating fluid (e.g., oil base). In other words, proper dispersion of NGPs in a fluid would be a prerequisite to achieving good electrical, thermal, and tribological (friction and wear) properties of the resulting nano-grease or nano-lubricant materials. These issues have not been addressed and the potential of using these highest-performing NGPs as an additive for lubricant or grease has not been explored.

It is therefore an object of the present invention to provide a cost-effective lubricant or grease composition that exhibits superior friction-reducing, anti-wear, thermal conductivity, and stable viscosity properties.

It is another object of the present invention to provide an NGP-modified lubricant or grease with improved wear and friction properties.

It is yet another object of the present invention to provide an NGP-containing lubricant or grease that exhibits improved heat transfer properties.

Still another object of the present invention is to provide a nano-lubricant or nano-grease that exhibits a better combination of friction, wear, and heat transfer properties as compared with a corresponding lubricant or grease composition containing CNTs or graphite nano particles.

SUMMARY OF THE INVENTION

The present invention provides a lubricant composition having improved lubricant properties, comprising: (a) a lubricating fluid; and (b) a plurality of nano graphene platelets dispersed in the fluid wherein the nano graphene platelets have a proportion of 0.001% to 75% by weight based on the total weight of the lubricating fluid and the graphene platelets (preferably between 0.01% and 60% by weight). The lubricating fluid may contain a dispersing agent dissolved in a neat fluid (e.g., oil). Preferably, the nano graphene platelets have an average thickness less than 10 nm and more preferably less than 1 nm. Most preferably, the nano graphene platelets comprise single-layer graphene. The nano graphene platelets can contain pristine graphene, graphene oxide, or a combination thereof. The lubricant properties that can be significantly improved by NGPs include, but are not limited to, friction, wear, viscosity, electrical conductivity, thermal conductivity, thermal stability, and molecular film formability (between working parts).

For certain applications, the nano graphene platelets preferably have a length or width greater than 1 μm so that they could cover a wider surface area of a working part. For other applications (e.g., in re-circulating systems), nano graphene platelets preferably have a length or width less than 500 nm. Preferably, the lubricating fluid is a type of oil having a molecular weight of from 250 to 1,000 g/mole. A thickener may be added to enhance the viscosity of the lubricant composition, to the extent that the lubricant becomes a grease composition. In a preferred embodiment, NGPs are used as a thickener, replacing part or all of the thickeners that otherwise would be added to make a grease composition.

In another preferred embodiment, the present invention provides a lubricant composition with enhanced thermal conductivities. The composition comprises a neat fluid, nano graphene platelets, and at least one surfactant, wherein the nano graphene platelets are between 0.001% and 60% by weight based on the total weight of the fluid and nano graphene platelets combined. More typically, NGPs are between 0.1% and 30% by weight. Preferably, the neat fluid is selected from the group consisting of petroleum distillates, synthetic petroleum oils, greases, gels, oil-soluble polymer composition, vegetable oils, and combinations thereof. The lubricating fluid can be a synthetic petroleum oil, which can be selected from the group consisting of polyalphaolefins, polyol esters, and combinations thereof. The polyol ester can be selected from the group consisting of pentaerythritol ester, trimethylolpropane ester, neopentyl glycol ester and combinations thereof. A combination of a dispersant and a neat fluid is also herein referred to as a "lubricating fluid."

The nano graphene platelets preferably have a thermal conductivity of no less than 500 W/m-K, more preferably no less than 1,000 W/m-K, and most preferably greater than 3,000 W/m-K. As a result, the overall lubricant composition preferably has a thermal conductivity greater than 1.0 W/m-K, more preferably greater than 10 W/m-K, and most preferably greater than 30 W/m-K.

A surfactant or dispersant (dispersing agent) may be used to assist in dispersing NGPs and other additives in the lubricating fluid and maintaining such dispersion for an extended period of time. The surfactant is preferably an anionic surfactant. The surfactant may be selected from the group consisting of a sulfonate surfactant, a sulfosuccinate, a sulfosuccinamate, dioctyl sulfosuccinate, bistridecyl sulfosuccinate, di(1,3-di-methylbutyl)sulfosuccinate, and combinations thereof. The amount of the surfactant is preferably about from 0.1 to about 30% by weight, although it can be less than 0.1% or greater than 30%. Most typically, the surfactant is between 1 and 10% by weight.

In the lubricant composition, the nano graphene platelet may be a single-layer graphene or multi-layer graphene and it can be pristine graphene or graphene oxide. The single-layer graphene is of particular interest due to the notion that it has a thickness of one carbon atom (<0.34 nm) and can strongly stick to any solid surface, forming a molecular-scale lubricating film. Hence, another preferred embodiment of the present invention is a lubricant composition comprising a lubricating fluid and at least one single-layer graphene sheet. Preferably, the composition comprises a plurality of single-layer graphene sheets.

NGPs can be pristine graphene or graphene oxide. The pristine graphene is preferably produced by direct ultrasonication of a pristine graphitic material that is not pre-intercalated and not pre-oxidized. The non-preintercalated and non-oxidized graphitic material may be selected from the group consisting of natural graphite, synthetic graphite, highly oriented pyrolytic graphite, carbon or graphite fiber, carbon or graphitic nano-fiber, meso-carbon micro-bead, and combinations thereof.

The present invention relates to compositions of nano-lubricants and nano-greases that contain NGPs to act not just as a heat-conducting agent, but also a friction-reducing and anti-wear agent. The nano-fluid of the present invention contains one or more surfactant to stabilize the NGP dispersion. Other conventional chemical additives can also be added to provide additional desired chemical and physical characteristics, such as anti-wear, corrosion protection and thermal oxidative properties. For the nano-greases of the present invention, NGPs also function as a thickening agent to modulate viscosity.

DETAILED DESCRIPTION OF PREFERRED EMBODIMENTS

Figure 1:
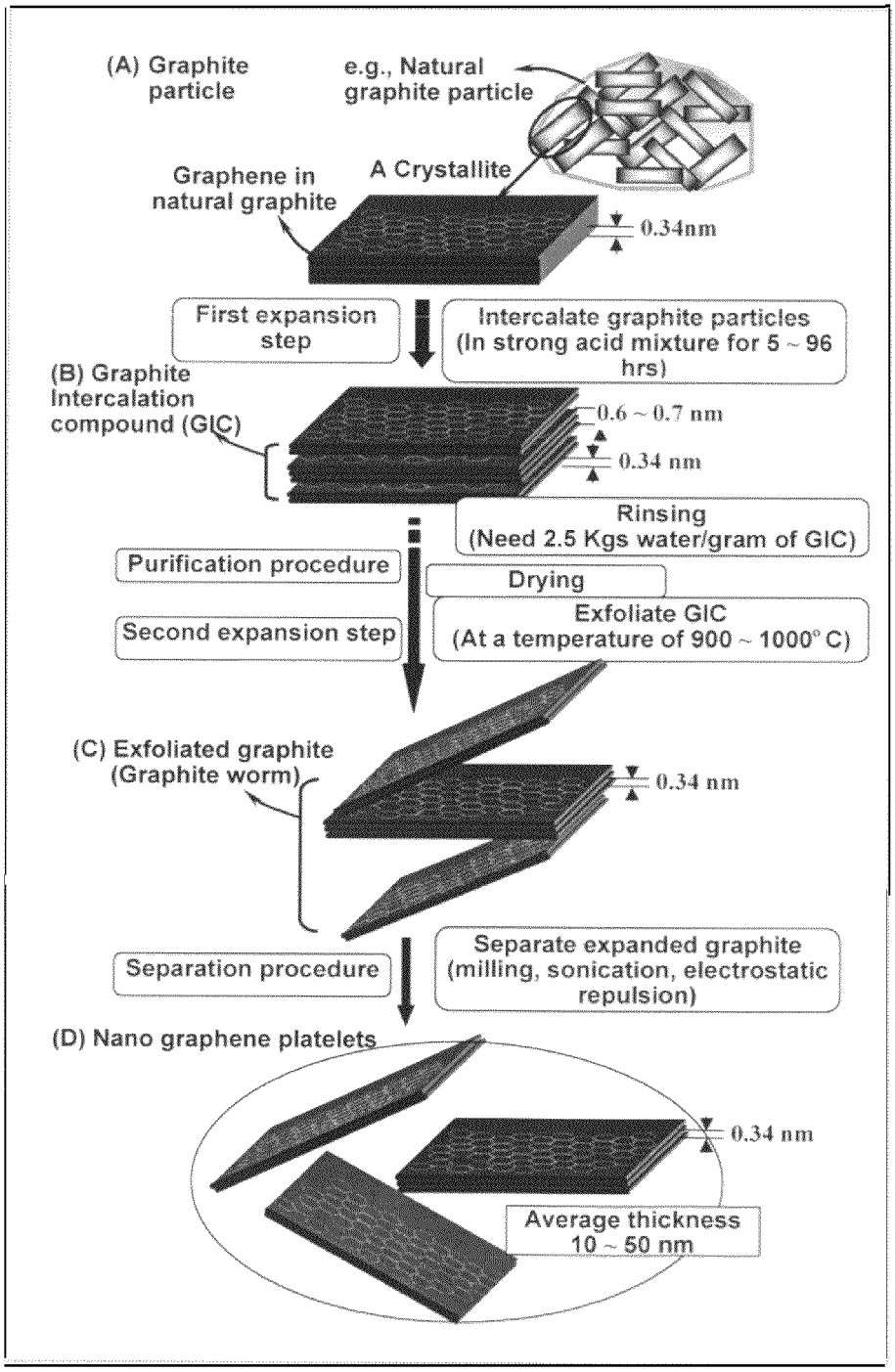
FIG. 1 Schematic of conventional processes for producing oxidized NGPs (also referred to as graphite oxide nano platelets).
Figure 2:
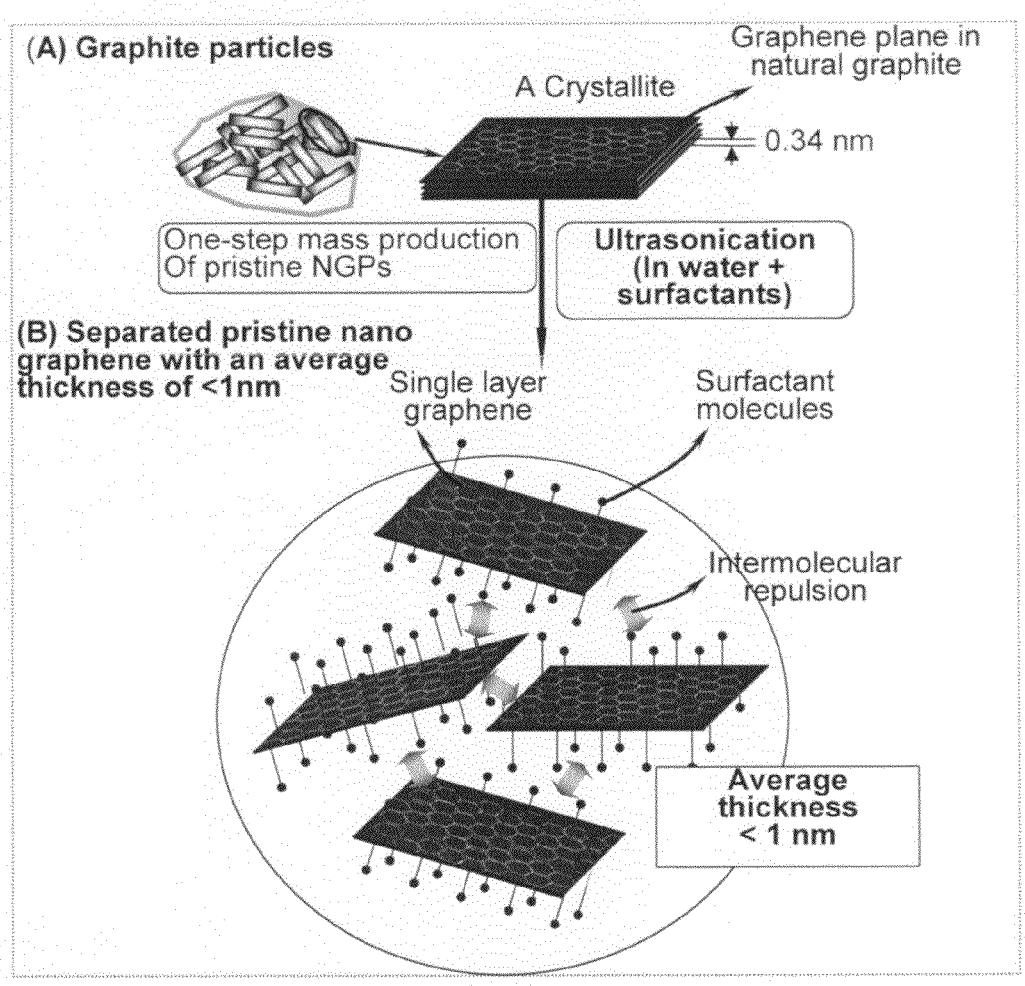
FIG. 2 Schematic of the direct ultrasonication process by which a pristine graphite material, without pre-intercalation or pre-oxidation (without exposing to any undesirable chemical such as sulfuric acid and nitric acid), can be directly exfoliated and separated into ultra-thin pristine NGPs.

Carbon materials can assume an essentially amorphous structure (glassy carbon), a highly organized crystal (graphite), or a whole range of intermediate structures that are characterized in that various proportions and sizes of graphite crystallites and defects are dispersed in an amorphous matrix. Typically, a graphite crystallite is composed of a number of graphene sheets or basal planes that are bonded together through van der Waals forces in the c-axis direction, the direction perpendicular to the basal plane. These graphite crystallites are typically micron- or nanometer-scaled. The graphite crystallites are dispersed in or connected by crystal defects or an amorphous phase in a graphite particle, which can be a graphite flake, carbon/graphite fiber segment, carbon/graphite whisker, or carbon/graphite nano-fiber. In the case of a carbon or graphite fiber segment, the graphene plates may be a part of a characteristic "turbostratic structure." These graphitic materials are regarded as three-dimensional entities. Through pulverizing and milling, these graphite particles may be size-reduced to sub-micron or slightly less than 500 nm in diameter and they are referred to as graphite nano particles.

Over the last two decades, two types of carbon allotropes were discovered: the zero-dimensional fullerene and one-dimensional carbon nanotube (CNT), which have significantly advanced the field of nano materials and nanotechnology. In most recent years, a new class of carbon-based material was developed—the nano graphene platelet (NGP). NGP may be considered a two-dimensional carbon material. An NGP is essentially composed of a sheet of graphene plane or multiple sheets of graphene plane stacked and bonded together. Each graphene plane, also referred to as a graphene sheet or basal plane, comprises a two-dimensional hexagonal structure of carbon atoms. Each platelet has a length and a width parallel to the graphite plane and a thickness orthogonal to the graphite plane. The thickness of an NGP, by definition, is 100 nanometers (nm) or smaller, but typically thinner than 10 nm with a single-sheet NGP being as thin as 0.34 nm. The length and width of a NGP are typically between 0.5 μm and 20 μm, but could be longer or shorter.

NGPs have been shown to exhibit the highest intrinsic strength and highest thermal conductivity of all materials ever studied by scientists. NGPs also have exceptional elastic modulus (approximately 1 TPa or 1,000 GPa) and high electrical conductivity (up to 20,000 S/cm). NGPs, if incorporated as fillers in a composite material, are expected to impart outstanding properties to the matrix material.

There are several unique features of NGPs that make them an ideal candidate for a lubricant or grease additive:

(1) For lubricant or grease applications, the ultra-high thermal conductivity of NGPs is of particular interest since, in most of the friction-reducing or anti-wear applications, adequate heat dissipation is an important requirement.

(2) The notion that NGPs can be as thin as one carbon atom size (<0.34 nm) suggests that NGPs could form a molecular sized lubricating film between two working parts, effectively reducing friction and wear. This is not possible with carbon nanotubes and graphite nano particles.

(3) Furthermore, a graphene plane is a structure of extended carbon hexagons or an extended fused-ring aromatic structure, which is more thermally and chemically stable than most of the organic molecules. This implies that graphene is capable of providing long-term, stable protection against friction and wear of working parts.

(4) The unique plate-like geometry enables NGPs to slide over one another, providing stable fluid properties (e.g., viscosity remains relatively stable with respect to shear rate or service time). This same geometry also enables a large proportion of NGPs (e.g., up to 75% by weight) to be dispersed in a fluid. This is in sharp contrast to the observation that one normally could not disperse more than 10% by weight (typically <5%) of CNTs in a liquid or solid.

The tremendous application potential has been largely overlooked in industry. After some diligent research and development efforts on NGPs as a modifier for lubricant or grease, the applicant has discovered many surprising results.

In particular, the present invention provides a lubricant composition having improved lubricant properties, comprising: (a) a lubricating fluid; and (b) a plurality of nano graphene platelets dispersed in the fluid wherein the nano graphene platelets have a proportion of 0.001% to 75% by weight based on the total weight of the lubricating fluid and the graphene platelets combined. The lubricating fluid can contain a dispersing agent or dispersant dissolved in a solvent, water, or base oil. Preferably, the nano graphene platelets have an average thickness less than 10 nm and more preferably less than 1 nm. Most preferably, the nano graphene platelets comprise single-layer graphene. The nano graphene platelets can contain pristine graphene, graphene oxide, or a combination thereof.

For certain applications, the nano graphene platelets preferably have a length or width greater than 1 μm. For other applications (e.g., in re-circulating systems), nano graphene platelets preferably have a length or width less than 500 nm to avoid the potential issue of clogging the ultra-small gaps through which the lubricant must flow freely. Preferably, the lubricating fluid is a type of oil having a molecular weight of from 250 to 1,000 g/mole.

A preferred group of lubricating fluids for use in the present invention includes organic substances containing primarily carbon, hydrogen and oxygen, e.g., oils from petroleum consisting essentially of complex mixtures of hydrocarbon molecules. More specifically, lubricating oil or "lube oil" refers to a selected fraction of refined mineral oil used for lubrication of moving surfaces, usually metallic surfaces, which cover from small precision machinery to the heaviest equipment. Lubricating oils usually contain additives to impart desired properties such as viscosity and detergency. They range in consistency from thin liquids to thick, grease-like substances.

The petroleum liquid medium can be any petroleum distillates or synthetic petroleum oils, greases, gels, or oil-soluble polymer composition. More typically, it is selected from the mineral basestocks or synthetic basestocks used in the lube industry, e.g., Group I (solvent refined mineral oils), Group II (hydrocracked mineral oils), Group III (severely hydrocracked oils, also referred to as synthetic or semi-synthetic oils), Group IV (polyalphaolefins), and Group VI (esters, naphthenes, and others). One preferred group includes the polyalphaolefins, synthetic esters, and polyalkylglycols. Silicone oil may also be used.

Useful synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-octenes), poly(1-decenes), etc., and mixtures thereof; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.), alkylated diphenyl, ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic oils. Another suitable class of synthetic oils comprises the esters of dicarboxylic acids (e.g., phtalic acid, succinic acid, alkyl succinic acids and alkenyl succinic acids, maleic acid, azelaic acid, suberic acid, sebacic acid, fumaric acid, adipic acid, alkenyl malonic acids, etc.) with a variety of alcohols (e.g., butyl alcohol, hexyl alcohol, dodecyl alcohol, 2-ethylhexyl alcohol, ethylene glycol diethylene glycol monoether, propylene glycol, etc.). Specific examples of these esters include dibutyl adipate, di(2-ethylhexyl) sebacate, di-hexyl fumarate, dioctyl sebacate, diisooctyl azelate, diisodecyl azealate, dioctyl phthalate, didecyl phthalate, dicicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters that are useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc. Other synthetic oils include liquid esters of phosphorus-containing acids (e.g., tricresyl phosphate, trioctyl phosphate, diethyl ester of decylphosphonic acid, etc.), polymeric tetrahydrofurans and the like.

Lubricating fluids generally range from low viscosity oils with molecular weights as low as 250 g/mole to very viscous lubricants with molecular weights as high as about 1,000 g/mole. Physical properties, such as viscosity, viscosity-temperature-pressure characteristics, and performance, depend largely on the relative distribution of paraffinic, aromatic, and alicyclic (naphthenic) components in the lubricating oil.

Representative petroleum lubricating oils used in this invention include lubes used to lubricate automobiles, gears, automatic transmissions, turbines, aviation engines, and refrigeration equipment. Greases, metal working lubricants, and lubricants for missile systems can also be used in the invention. These examples are given for illustrative purposes and should not be construed as limiting the scope of this invention.

The lubricating fluid of the present invention may comprise a thermal transfer fluid, which can be selected from a wide variety of well-known organic oils, including petroleum distillates, synthetic petroleum oils, greases, gels, oil-soluble polymer compositions, water-soluble polymer compositions, vegetable oils, and combinations thereof. Petroleum distillates, also known as mineral oils, generally include paraffins, naphthenes and aromatics.

Synthetic petroleum oils are the major class of lubricants widely used in various industries. Examples include alkylaryls such as dodecylbenzenes, tetradecylbenzenes, dinonylbenzenes, and di-(2-ethylhexyl)benzenes; polyphenyls such as biphenyls, terphenyls, and alkylated polyphenyls; fluorocarbons such as polychlorotrifluoroethylenes and copolymers of perfluoroethylene and perfluoropropylene; polymerized olefins such as polybutylenes, polypropylenes, propylene-isobutylene copolymers, chlorinated polybutylenes, poly(1-octenes), and poly(1-decenes); organic phosphates such as triaryl or trialkyl phosphates, tricresyl phosphate, trioctyl phosphate, and diethyl ester of decylphosphonic acid; and silicates such as tetra(2-ethylhexyl) silicate, tetra(2-ethylbutyl) silicate, and hexa(2-ethylbutoxy) disiloxane. Other examples include polyol esters, polyglycols, polyphenyl ethers, polymeric tetrahydrofurans, and silicones.

The lubricating fluid can comprise a diester, which is formed through the condensation of a dicarboxylic acid, such as adipic acid, azelaic acid, fumaric acid, maleic acid, phtalic acid, sebacic acid, suberic acid, and succinic acid, with a variety of alcohols with both straight, cyclic, and branched chains, such as butyl alcohol, dodecyl alcohol, ethylene glycol diethylene glycol monoether, 2-ethylhexyl alcohol, isodecyl alcohol, hexyl alcohol, pentaerytheritol, propylene glycol, tridecyl alcohol, and trimethylolpropane. Modified dicarboxylic acids, such as alkenyl malonic acids, alkyl succinic acids, and alkenyl succinic acids, can also be used. Specific examples of these esters are dibutyl adipate, diisodecyl azelate, diisooctyl azelate, di-hexyl fumarate, dioctyl phthalate, didecyl phthalate, di(2-ethylhexyl) sebacate, dioctyl sebacate, dicicosyl sebacate, and the 2-ethylhexyl diester of linoleic acid dimer. This class of lubricating fluid is also a thermal transfer fluid.

Alternatively, the lubricating fluid may comprise a polyalphaolefin, which is formed through oligomerization of 1-olefines containing 2 to 32 carbon atoms, or mixtures of such olefins. Some common alphaolefins are 1-octene, 1-decene, and 1-dodecene. Examples of polyalphaolefins include poly-1-octene, poly-1-decene, poly-1-dodecene, mixtures thereof, and mixed olefin-derived polyolefins. This type of lubricating fluid can also be used as a thermal transfer fluid. Further alternatively, the desired lubricating fluid may comprise a polyol ester which is formed through the condensation of a monocarboxylic acid containing 5 to 12 carbons and a polyol and a polyol ether such as neopentyl glycol, trimethylolpropane, pentaerythritol, dipentaerythritol, and tripentaerythritol. Generally speaking, polyol esters have good oxidation and hydrolytic stability. The polyol ester for use herein preferably has a pour point of about −100° C. to −40° C. and a viscosity of about 2 to 100 centistoke at 100° C.

Another useful class of lubricating fluid is a polyglycol, which is an alkylene oxide polymer or copolymer. The terminal hydroxyl groups of a polyglycol can be further modified by esterification or etherification to generate another class of known synthetic oils. Mixtures of propylene and ethylene oxides in the polymerization process will produce a water-soluble lubricant oil. Liquid or oil type polyglycols have lower viscosities and molecular weights of about 400 g/mole. Polyglycols with a molecular weight of 3,000 g/mole or higher are viscous polymers at room temperature and may be used for high temperature lubrication applications.

Alternatively, the lubricating fluid may be a combination of two or more selected from the group consisting of petroleum distillates, synthetic petroleum oils, greases, gels, oil-soluble polymer composition, and vegetable oils. Suitable examples include a mixture of two polyalphaolefins, a mixture of two polyol esters, a mixture of one polyalphaolefine and one polyol ester, a mixture of three polyalphaolefins, a mixture of two polyalphaolefins and one polyol ester, a mixture of one polyalphaolefin and two polyol esters, and a mixture of three polyol esters. In all the combinations, the fluid preferably has a viscosity of from about 1 to about 1,000 centistokes, more preferably from about 2 to about 800 centistokes, and most preferably from about 5 to about 500 centistokes.

In a preferred embodiment, the lubricating fluid is grease, which is made by combining a petroleum or synthetic lubricating fluid with a thickening agent. The thickeners are generally silica gel and fatty acid soaps of lithium, calcium, strontium, sodium, aluminum, and barium. The grease formulation may also include coated clays, such as bentonite and hectorite clays coated with quaternary ammonium compounds. Carbon black may be added as a thickener to enhance high-temperature properties of petroleum and synthetic lubricant greases. In practicing the present invention, NGPs can be used to replace some, if not all, of the conventional thickeners. In other words, when NGPs are added to improve the thermal conductivity of the lubricant, the fluid viscosity is also increased concomitantly.

The addition of organic pigments and powders, which include arylurea compounds indanthrene, ureides, and phthalocyanines, provide high temperature stability. Sometimes, solid powders, such as conventional graphite, molybdenum disulfide, talc, and zinc oxide, are also added to provide boundary lubrication. NGPs can replace all of these ingredients to achieve boundary lubrication. Formulating the aforementioned synthetic lubricant oils with thickeners provides specialty greases. The synthetic lubricant oils include diesters, polyalphaolefins, polyol esters, polyglycols, silicone-diester, and silicone lubricants. NGPs may also be used to replace some or all of non-melting thickeners, such as copper phthalocyanine, arylureas, indanthrene, and organic surfactant coated clays.

The NGP-modified grease composition of the present invention preferably contains from about 40 to about 99% by weight of a lubricating fluid, preferably from about 70 to about 98%, more preferably from about 80 to about 96%, and most preferably from about 85 to about 96%. The lubricating fluid preferably has a viscosity of from about 2 to about 800 centistokes, more preferably from about 4 to about 500 centistokes, and most preferably from about 10 to about 200 centistokes. The NGP-modified nano-grease preferably contains about 0.1% to about 60% by weight of NGPs, more preferably from about 5% to about 30%, and most preferably from about 10% to about 20%. This amount of NGPs can be increased proportionally if the amount of conventional thickeners is decreased.

In a lubricant composition of the present invention, a variety of surfactants can be used as a dispersant to facilitate uniform dispersion of NGPs in a lubricating fluid, and to enhance stabilization of such dispersion as well. Typically, the surfactants used in the present invention contain a lipophilic hydrocarbon group and a polar functional hydrophilic group. The polar functional group can be of the class of carboxylate, ester, amine, amide, imide, hydroxyl, ether, nitrile, phosphate, sulfate, or sulfonate. The surfactant can be anionic, cationic, nonionic, zwitterionic, amphoteric and ampholytic.

Anionic surfactants include sulfonates such as alkyl sulfonates, alkylbenzene sulfonates, alpha olefin sulfonates, paraffin sulfonates, and alkyl ester sulfonates; sulfates such as alkyl sulfates, alkyl alkoxy sulfates, and alkyl alkoxylated sulfates; phosphates such as monoalkyl phosphates and dialkyl phosphates; phosphonates; carboxylates such as fatty acids, alkyl alkoxy carboxylates, sarcosinates, isethionates, and taurates. Specific examples of carboxylates are sodium cocoyl isethionate, sodium methyl oleoyl taurate, sodium laureth carboxylate, sodium trideceth carboxylate, sodium lauryl sarcosinate, lauroyl sarcosine, and cocoyl sarcosinate.

Specific examples of sulfates include sodium dodecyl sulfate, sodium lauryl sulfate, sodium laureth sulfate, sodium trideceth sulfate, sodium tridecyl sulfate, sodium cocyl sulfate, and lauric monoglyceride sodium sulfate. Specific sulfonate surfactants include alkyl sulfonates, aryl sulfonates, monoalkyl and dialkyl sulfosuccinates, and monoalkyl and dialkyl sulfosuccinamates. Each alkyl group independently contains about two to twenty carbons and can also be ethoxylated with up to about 8 units, preferably up to about 6 units, on average, e.g., 2, 3, or 4 units, of ethylene oxide, per each alkyl group. Illustrative examples of alky and aryl sulfonates are sodium tridecyl benzene sulfonate and sodium dodecylbenzene sulfonate.

Examples of usable sulfosuccinates include dimethicone copolyol sulfosuccinate, diamyl sulfosuccinate, dicapryl sulfosuccinate, dicyclohexyl sulfosuccinate, diheptyl sulfosuccinate, dihexyl sulfosuccinate, diisobutyl sulfosuccinate, dioctyl sulfosuccinate, cetearyl sulfosuccinate, cocopolyglucose sulfosuccinate, cocoyl butyl gluceth-10 sulfosuccinate, deceth-5 sulfosuccinate, deceth-6 sulfosuccinate, dihydroxyethyl sulfosuccinylundecylenate, hydrogenated cottonseed glyceride sulfosuccinate, isodecyl sulfosuccinate, isostearyl sulfosuccinate, laureth-5-sulfosuccinate, laureth sulfosuccinate, laureth-12 sulfosuccinate, laureth-6 sulfosuccinate, laureth-9 sulfosuccinate, lauryl sulfosuccinate, nonoxynol-10 sulfosuccinate, oleth-3 sulfosuccinate, oleyl sulfosuccinate, PEG-10 laurylcitrate sulfosuccinate, sitosereth-14 sulfosuccinate, stearyl sulfosuccinate, tallow, tridecyl sulfosuccinate, ditridecyl sulfosuccinate, bisglycol ricinosulfosuccinate, di(1,3-di-methylbutyl) sulfosuccinate, and silicone copolyol sulfosuccinates.

For an anionic surfactant, the counter ion is typically sodium but may alternatively be potassium, lithium, calcium, magnesium, ammonium, amines (primary, secondary, tertiary or quandary) or other organic bases. Examples of amines include isopropylamine, ethanolamine, diethanolamine, triethanolamine, and mixtures thereof. Examples of cationic surfactants include primarily organic amines, primary, secondary, tertiary or quaternary. For a cationic surfactant, the counter ion can be chloride, bromide, sulfate, lactate, saccharinate, acetate and phosphate. Examples of cationic amines include polyethoxylated oleyl/stearyl amine, ethoxylated tallow amine, cocoalkylamine, oleylamine, and tallow alkyl amine.

Non-ionic surfactants include polyalkylene oxide carboxylic acid esters, fatty acid esters, fatty alcohols, ethoxylated fatty alcohols, poloxamers, alkanolamides, alkoxylated alkanolamides, polyethylene glycol monoalkyl ether, and alkyl polysaccharides. Polyalkylene oxide carboxylic acid esters have one or two carboxylic ester moieties each with about 8 to 20 carbons and a polyalkylene oxide moiety containing about 5 to 200 alkylene oxide units. A ethoxylated fatty alcohol contains an ethylene oxide moiety containing about 5 to 150 ethylene oxide units and a fatty alcohol moiety with about 6 to about 30 carbons. The fatty alcohol moiety can be cyclic, straight, or branched, and saturated or unsaturated.

Some examples of ethoxylated fatty alcohols include ethylene glycol ethers of oleth alcohol, steareth alcohol, lauryl alcohol and isocetyl alcohol. Poloxamers are ethylene oxide and propylene oxide block copolymers, having from about 15 to about 100 moles of ethylene oxide. Specific examples of suitable nonionic surfactants include alkanolamides such as cocamide diethanolamide (DEA), cocamide monoethanolamide (MEA), cocamide monoisopropanolamide (MIPA), PEG-5 cocamide MEA, lauramide DEA, and lauramide MEA; alkyl amine oxides such as lauramine oxide, cocamine oxide, cocamidopropylamine oxide, and lauramidopropylamine oxide; sorbitan laurate, sorbitan distearate, fatty acids or fatty acid esters such as lauric acid, isostearic acid, and PEG-150 distearate; fatty alcohols or ethoxylated fatty alcohols such as lauryl alcohol, alkylpolyglucosides such as decyl glucoside, lauryl glucoside, and coco glucoside.

Select zwitterionic surfactants can have both a formal positive and negative charge on the same molecule. The positive charge group can be quaternary ammonium, phosphonium, or sulfonium, whereas the negative charge group can be carboxylate, sulfonate, sulfate, phosphate or phosphonate. Similar to other classes of surfactants, the hydrophobic moiety may contain one or more long, straight, cyclic, or branched, aliphatic chains of about 8 to 18 carbon atoms. Specific examples of zwitterionic surfactants include alkyl betaines such as cocodimethyl carboxymethyl betaine, lauryl dimethyl carboxymethyl betaine, lauryl dimethyl alpha-carboxyethyl betaine, cetyl dimethyl carboxymethyl betaine, lauryl bis-(2-hydroxyethyl)carboxy methyl betaine, stearyl bis-(2-hydroxypropyl)carboxymethyl betaine, oleyl dimethyl gamma-carboxypropyl betaine, and lauryl bis-(2-hydroxypropyl)alphacarboxy-ethyl betaine, amidopropyl betaines; and alkyl sultaines such as cocodimethyl sulfopropyl betaine, stearyidimethyl sulfopropyl betaine, lauryl dimethyl sulfoethyl betaine, lauryl bis-(2-hydroxyethyl)sulfopropyl betaine, and alkylamidopropylhydroxy sultaines.

Amphoteric surfactants include ammonium or substituted ammonium salts of alkyl amphocarboxy glycinates and alkyl amphocarboxypropionates, alkyl amphodipropionates, alkyl amphodiacetates, alkyl amphoglycinates, and alkyl amphopropionates, as well as alkyl iminopropionates, alkyl iminodipropionates, and alkyl amphopropylsulfonates. Specific examples are cocoamphoacetate, cocoamphopropionate, cocoamphodiacetate, lauroamphoacetate, lauroamphodiacetate, lauroamphodipropionate, lauroamphodiacetate, cocoamphopropyl sulfonate, caproamphodiacetate, caproamphoacetate, caproamphodipropionate, and stearoamphoacetate.

Polymeric surfactants include N-substituted polyisobutenyl succinimides and succinates, alkyl methacrylate vinyl pyrrolidinone copolymers, alkyl methacrylate-dialkylaminoethyl methacrylate copolymers, alkylmethacrylate polyethylene glycol methacrylate copolymers, and polystearamides. Suitable oil-based dispersants include alkylsuccinimide, succinate esters, high molecular weight amines, and phosphoric acid derivatives. Some specific examples are polyisobutenyl succinimide-polyethylenepolyamine, polyisobutenyl succinic ester, polyisobutenyl hydroxybenzyl-polyethylenepolyamine, and bis-hydroxypropyl phosphorate.

The NGP-modified lubricant composition may also contain one or more other chemicals to provide other desired chemical and physical properties and characteristics. Such chemical additives include antioxidants, corrosion inhibitors, copper corrosion inhibitors, friction modifiers, viscosity improvers, pour point depressants, and seal-swelling agents.

Examples of antioxidants include phenolic antioxidants, aromatic amine antioxidants, sulfurized phenolic antioxidants, and organic phosphates. Examples include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol), mixed methylene-bridged polyalkyl phenols, 4,4'-thiobis(2-methyl-6-tert-butylphenol), N,N'-di-sec-butyl-p-phenylenediamine, 4-isopropylaminodiphenylamine, phenyl-alpha-naphthylamine, and phenyl-beta-naphthylamine.

Examples of corrosion inhibitors include dimer and trimer acids, such as those produced from tall oil fatty acids, oleic acid, or linoleic acid; alkenyl succinic acid and alkenyl succinic anhydride corrosion inhibitors, such as tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride; and the half esters of alkenyl succinic acids having 8 to 24 carbon atoms in the alkenyl group with alcohols such as the polyglycols. Other suitable corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof. Examples of copper corrosion inhibitors include thiazoles such as 2-mercapto benzothiazole; triazoles such as benzotriazole, tolyltriazole, octyltriazole, decyltriazole, and dodecyltriazole; and thiadiazoles such as 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-(bis)hydrocarbyldithio)-1,3,4-thiadiazoles.

Friction modifiers that can be selected for use in the NGP-modified lubricant include aliphatic amines, aliphatic fatty acid amides, aliphatic carboxylic acids, aliphatic carboxylic esters, aliphatic carboxylic ester-amides, aliphatic phosphonates, aliphatic phosphates, aliphatic thiophosphonates, and aliphatic thiophosphates, wherein the aliphatic group usually contains above about eight carbon atoms so as to render the compound suitably oil soluble. Also suitable are aliphatic substituted succinimides formed by reacting one or more aliphatic succinic acids or anhydrides with ammonia. It may be noted that NGPs, particularly ultra-thin NGPs (thickness <10 nm), are highly effective friction modifiers. The needed amount of conventional friction modifiers can be significantly reduced if some NGPs are added to improve other desirable properties (e.g., thermal conductivity). NGPs are a multifunctional lubricant additive.

Viscosity enhancers that can be selected for use in the NGP-modified lubricant include olefin copolymers, polymethacrylates, hydrogenated styrene-diene, and styrene-polyester polymers. Also suitable are acrylic polymers such as polyacrylic acid and sodium polyacrylate; high-molecular-weight polymers of ethylene oxide; cellulose compounds such as carboxymethylcellulose; polyvinyl alcohol; polyvinyl pyrrolidone; xanthan gums and guar gums; polysaccharides; alkanolamides; amine salts of polyamide; hydrophobically modified ethylene oxide urethane; silicates; and fillers such as mica, silicas, cellulose, wood flour, clays (including organoclays) and nanoclays; and resin polymers such as polyvinyl butyral resins, polyurethane resins, acrylic resins and epoxy resins.

Most pour point depressants are organic polymers, although some nonpolymeric substances have been shown to be effective. Both nonpolymeric and polymeric depressants can be used in the present invention. Examples include alkylnaphthalenes, polymethacrylates, polyfumarates, styrene esters, oligomerized alkylphenols, phthalic acid esters, ethylenevinyl acetate copolymers, and other mixed hydrocarbon polymers. The treatment level of these additives is usually low. In nearly all cases, there is an optimum concentration above and below which pour point depressants become less effective.

Seal-swelling agents that can be used include dialkyl diesters of adipic, azelaic, sebacic, and phthalic acids. Examples of such materials include n-octyl, 2-ethylhexyl, isodecyl, and tridecyl diesters of adipic acid, azelaic acid, and sebacic acid, and n-butyl, isobutyl, pentyl, hexyl, heptyl, octyl, nonyl, decyl, undecyl, dodecyl, and tridecyl diesters of phthalic acid. Also useful are aromatic hydrocarbons with suitable viscosity.

In addition to the chemicals listed, many other known types of additives such as dyes, foam inhibitors, demulsifiers, and air release agents, can also be included in finished compositions produced and/or used in the practice of the present invention. In general, the additive components are employed in the NGP-modified fluid (nano-fluid) in minor amounts sufficient to enhance the performance characteristics and properties of the base fluid. The amounts will thus vary according to such factors as the viscosity characteristics of the base fluid employed, the viscosity characteristics desired in the finished fluid, the service conditions for which the finished fluid is intended, and the performance characteristics desired in the finished fluid. Furthermore, the lubricant composition of the present invention may further comprise a graphite nano particle or a carbon nanotube, if so desired.

The following examples serve to provide the best modes of practice for the present invention, and should not be construed as limiting the scope of the invention:

EXAMPLE 1

Pristine Nano-Scaled Graphene Platelets (NGPs) Prepared by Direct Ultrasonication of Natural Graphite Particles Five grams of graphite flakes, ground to approximately 20 μm or less in sizes, were dispersed in 1,000 mL of deionized water (containing 0.1% by weight of a dispersing agent, Zonyl® FSO from DuPont) to obtain a suspension. An ultrasonic energy level of 85 W (Branson S450 Ultrasonicator) was used for exfoliation, separation, and size reduction for a period of 2 hours. The resulting suspension contains a huge number of ultra-thin graphene sheets floating in water. These nano graphene sheets were collected by spray-drying. TEM examination of the dried NGPs indicates that most of these NGPs had 1-5 graphene layers.

EXAMPLE 2

Exfoliation and Separation of Graphite Oxide

Graphite oxide was prepared by oxidation of graphite flakes with sulfuric acid, nitrate, and permanganate according to the method of Hummers [U.S. Pat. No. 2,798,878, Jul. 9, 1957]. Upon completion of the reaction, the mixture was poured into deionized water and filtered. The graphite oxide was repeatedly washed in a 5% solution of HCl to remove most of the sulphate ions. The sample was then washed repeatedly with deionized water until the pH of the filtrate was neutral. The slurry was spray-dried and stored in a vacuum oven at 60° C. for 24 hours. The interlayer spacing of the resulting laminar graphite oxide was determined by the Debey-Scherrer X-ray technique to be approximately 0.73 nm (7.3 Å).

Graphite oxide was then inserted into a quartz tube at a temperature of 1,050° C. for 60 seconds under a flowing nitrogen condition to obtain exfoliated graphite oxide. The exfoliated graphite oxide was then ultrasonicated in water (no surfactant) for 15 minutes to obtain graphene oxide platelets. TEM examination of the resulting NGPs indicates the platelets are predominately single-layer graphene.

EXAMPLE 3

Graphite Nanoparticles Prepared from Natural Graphite

Natural graphite particles approximately 10 μm in size, along with small stainless steel balls, were sealed in two chambers of a high-energy ball mill. Ball milling was allowed to proceed with a small amount of graphite particles being sampled out every 12 hours or so to monitor the particle size. After approximately 96 hours, the average graphite particle size was found to be approximately 380 nm. Approximately 120 grams of graphite nanoparticles were prepared.

EXAMPLE 4

Thermal Conductivities of Various Lubricant Compositions

In order to compare and contrast the thermal conductivity of various lubricant compositions (including greases), three different carbon nano materials (NGPs, CNTs, and graphite nanoparticles) at several different proportions were incorporated into the same lubricating fluids. The nano-fluid was prepared by mixing nano carbon material (NGPs, CNTs, or GN particles), a dispersant, a base fluid together according to the proportions specified in the table below. The mixture was then sonicated using Digital Sonifier Model 405C by Branson Ultrasonics Corporation (Monroe Township, N.J.). The sonication was carried out at a low power level (<60 watts) intermittently at room temperature for 15 to 30 min, to avoid damaging and altering the structures of graphite nanoparticles, graphene platelets, or nanotubes. Typically, the carbon nanoparticle-containing suspension (cooled by an ice-water mixture bath) was energized for 1-2 min with a break about 5 min in between.

The thermal conductivity data for the lubricating fluid (neat fluid+dispersant) and the corresponding carbon nano material-modified fluid are shown in Table 1.

TABLE 1

Thermal conductivity data of modified lubricating fluids (GN = graphite nano particles, CNT = carbon nanotubes, NGP = Nano graphene platelets, VI = viscosity index, ACRYLOID = Polyalkylmethacrylate; Samples 7 and 8 are grease compositions).

| Sample No. | Base Fluid | Dispersant | Carbon Nano Material | Other Additives | Thermal Cond. of Neat Fluid + Dispersant (W/m-K) | Thermal Cond. of Lubricant Composition (W/m-K) |
|---|---|---|---|---|---|---|
| 1 | Poly (α-olefin), 92.7% | Polyammine, 4.8% | NGPs, 2.5% | None | 0.146 | 1.32 |
| 2 | Poly (α-olefin), 92.7% | Polyammine, 4.8% | MW-CNTs, 2.5% | None | 0.146 | 0.384 |
| 3 | Poly (α-olefin), 92.7% | Polyammine, 4.8% | GN, 2.5% | None | 0.146 | 0.174 |
| 4 | Poly (α-olefin), 71.6% | Polyammine, 3.4% | NGPs, 20% | None | 0.146 | 12.1 |
| 5 | Poly (α-olefin), 52% | Polyammine, 3.0% | NGPs, 45% | None | 0.146 | 33.4 |
| 6 | Poly (α-olefin), 71.6% | Polyammine, 3.4% | GN, 20% | None | 0.146 | 1.18 |
| 7 | Group III base oil, 57% | Lubrizol, 4.5% | Oxidized NGP, 30% | 8.5% VI improver, ACRYLOID | 0.140 | 20.2 |
| 8 | Group III base oil, 57% | Lubrizol, 4.5% | GN, 30% | 8.5% VI improver, ACRYLOID | 0.140 | 1.43 |

A comparison of Samples 1-3 indicates that NGPs are much more effective than both CNTs and graphite nano particles (GN) in enhancing the thermal conductivity of a lubricating fluid. Given the same weight fraction (2.5%), the thermal conductivity of NGP-modified fluid is 7.5 times higher than that of the graphite nano particle-modified version. By increasing the NGP content to 20% by weight (Sample 4) and 45% by weight (Sample 5), thermal conductivity of the lubricant composition reaches an unprecedented level of 12.1 and 33.4 W/m-K, the best ever reported for lubricants. The grease composition of Sample 7 (30% slightly oxidized NGPs) exhibits a thermal conductivity of 20.2 W/m-k, 14 times higher than that of a corresponding grease composition (30% graphite nano particles). These observations further validate the commonly accepted notion that NGPs are a fundamentally different and patently distinct class of nano materials than CNTs or graphite nano particles.

EXAMPLE 5

Figure 3:
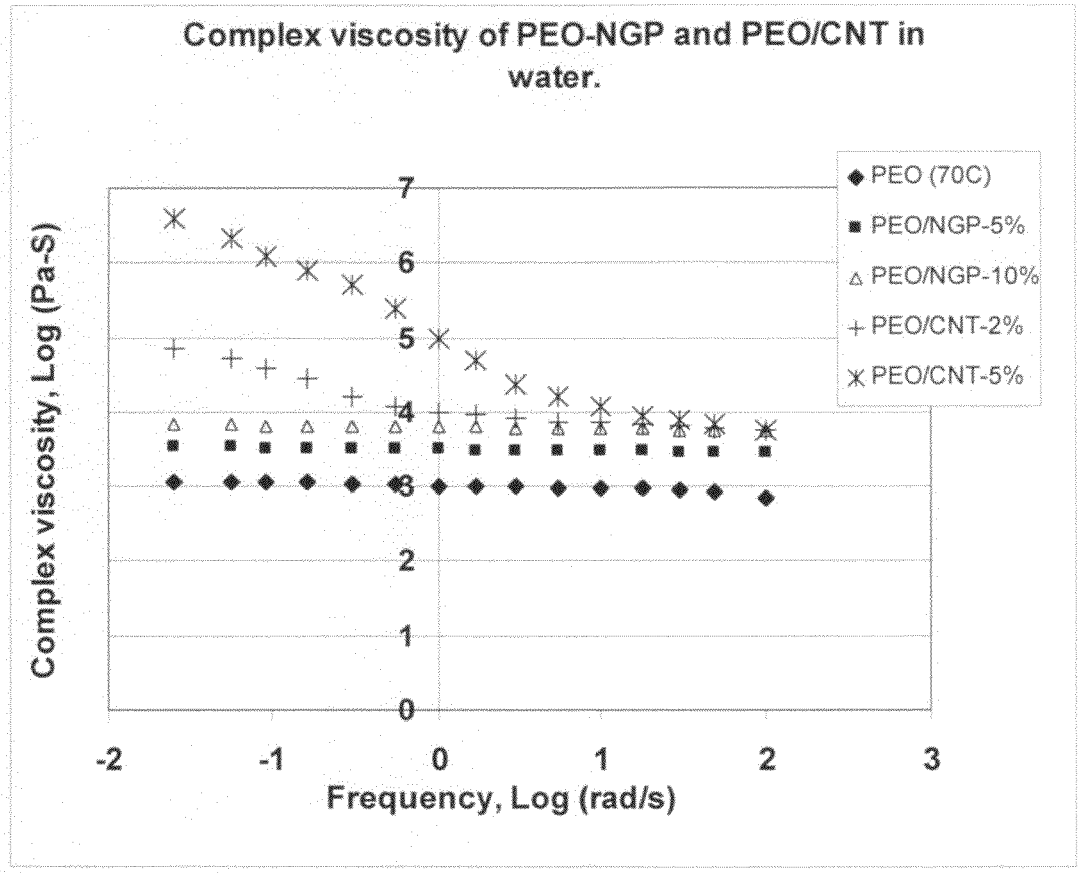
FIG. 3 Complex viscosity values of lubricants containing either NGPs or CNTs are plotted as a function of the frequency, equivalent to a shear rate.

Variations of Viscosity with Shear Rates (Frequency) of NGP-Modified and CNT-Modified Lubricant Compositions Polyethylene oxide (PEO), a water-soluble polymer, can be a thermal transfer fluid if used above its melting point or in a water solution. In the present study, 5% by weight of PEO was dissolved in water to form a solution. Several different weight fractions of NGPs and CNTs were separately added to the PEO solution to form lubricant or grease compositions. The complex viscosity values of these compositions were plotted over several decades of frequencies with the purpose of trying to understand how the frequency, corresponding to the shear rate, would affect the viscosity of the fluid compositions. This is a significant test since many lubricants must work in a dynamic environment wherein the velocity, shear rate, or frequency of the moving or rotational parts varies with time. It would be desirable to have a more stable lubricant viscosity that does not significantly vary with the moving velocity or frequency of the working parts. The data summarized in FIG. 3 clearly demonstrates that the NGP-containing fluid is much more stable against the variation in frequency. This might be due to the platelet geometry that enables NGPs to more easily slide over one another irrespective of the shear rate or frequency. In contrast, CNTs tend to aggregate or entangle with one another making the fluid viscosity excessively high when the shear rates are low. A higher shear rate could possibly break up the aggregate or untangle the individual filaments, leading to a lower fluid viscosity. This implies that the high-rate or long-term viscosity stability of CNT-modified fluids is questionable.

EXAMPLE 6

Friction-Reducing and Anti-Wear Performance of Lubricant Compositions

Group III base oil (90%) and 5% of Lubrizo-9802 (Lubrizol Corp., Wickliffe, Ohio) were mixed and used to disperse therein 5% by weight of NGPs, graphite nano particles, and NGPs, respectively, to prepare three separate lubricant compositions.

Friction and wear properties of the nano-lubricants were investigated using both the four-ball and ball-on-disk tests on an MMW-1 Universal Friction and Wear Tester (Jinan Testing Machine Work, Jinan, China). For the four-ball test, the steel balls were made of SAE 52100 with a radius of 12.7 mm and hardness HRc of 59-61. The ball-on-disk test was conducted with a mirror-polished steel ball counter-face (diameter 6 mm) under room temperature and 40% relative humidity. The velocity was maintained at 0.1 μm/s.

Table 2 shows that NGP-containing lubricants could significantly reduce the friction coefficient of the solid working surfaces. NGP-containing lubricants exhibit much better friction-reducing performance as compared with either graphite nano particle- or CNT-containing lubricants. NGPs of lower average thickness are more effective than NGPs of higher average thickness. The NGPs with an average thickness less than 1 nm (mostly single-layer graphene) provide particularly impressive frictional properties. The steel balls, after the test, were all coated with a monolayer of graphene, giving rise to a smooth, shiny surface texture. This observation confirms the significance of single-layer graphene due to the notion that it has a thickness of one carbon atom (<0.34 nm) and can strongly stick to any solid surface, forming a molecular-scale lubricating film.

TABLE 2

Friction coefficients for several frictional pairs lubricated with various lubricants (load = 50 N)

| Frictional pair (ball/disk) | Friction coefficient of solid surfaces with lubricants modified by: NGPs (thickness < 30 nm) | Graphite nano particles | CNTs |
|---|---|---|---|
| Steel/Steel | 0.065 | 0.103 | 0.121 |
| Steel/Al | 0.042 | 0.112 | 0.102 |
| Steel/Cu | 0.024 | 0.107 | 0.104 |
| Steel/Steel | 0.047 (NGP thickness < 10 nm) | — | — |
| Steel/Steel | 0.033 (NGP thickness < 1 nm) | — | — |

NGP-modified lubricants also exhibit good lubricity at elevated temperatures. Table 3 shows the wear rate results for three lubricant compositions under a steel/steel contact at 100° C. At a load of 300 N, the wear volume of the disc lubricated with the NGP-modified fluid is less than one half of that lubricated with either graphite nano particles or carbon nanotubes. NGP-modified fluids also can endure much higher loads.

TABLE 3

Tribological properties of several lubricant compositions measured with steel/steel contacts at 100° C.

| Load (N) | Wear volumes ($\times 10^{-4}$ mm$^3$) in lubricants modified by: NGPs | Graphite nano particles | CNTs |
|---|---|---|---|
| 100 | 1.41 | 1.60 | 1.46 |
| 200 | 2.62 | 4.12 | 3.87 |
| 300 | 3.07 | 6.45 | 6.55 |
| 400 | 3.63 | Lubrication failure (LF) | LF |
| 600 | 4.54 | LF | LF |

In conclusion, the presently invented NGP-modified lubricant or grease compositions exhibit superior tribological, rheological, and thermal characteristics as compared with corresponding compositions containing either graphite nano particles or carbon nano-tubes. In particular, the thermal conductivity, friction-reducing ability, anti-wear capability, and viscosity stability of NGP-modified compositions are truly exceptional. For instance, some of the thermal conductivity values of NGP-containing fluids are the highest ever reported for fluid materials. These highly surprising results could not be and have not been achieved with carbon nanotubes or graphite nano particles. No prior art has taught about the NGP-containing lubricant composition.

The invention claimed is:

1. A lubricant composition having improved lubricant properties, comprising:

(a) a lubricating fluid; and (b) nano graphene platelets dispersed in said fluid, wherein said nano graphene platelets have a proportion of 0.001% to 75% by weight based on the total weight of the fluid and the graphene platelets combined.

2. The lubricant composition as recited in claim 1, further comprising a surfactant or dispersant.

3. The lubricant composition as recited in claim 1, wherein said nano graphene platelets have an average thickness less than 10 nm.

4. The lubricant composition as recited in claim 1, wherein said nano graphene platelets have an average thickness less than 1 nm.

5. The lubricant composition as recited in claim 1, wherein said nano graphene platelets comprise single-layer graphene.

6. The lubricant composition as recited in claim 1, wherein said nano graphene platelets have a length or width less than 500 nm.

7. The lubricant composition as recited in claim 1, wherein said nano graphene platelets comprise pristine graphene, graphene oxide, or a combination thereof.

8. A lubricant composition with an enhanced thermal conductivity, comprising:

A) an effective amount of a selected neat fluid having a selected thermal conductivity;

B) an amount of from 0.001 to 60 percent by weight of nano graphene platelets dispersed into said selected neat fluid; and C) an effective amount of at least one dispersing agent dissolved or dispersed in said neat fluid.

9. The lubricant composition of claim 8, wherein the neat fluid is selected from the group consisting of petroleum distillates, synthetic petroleum oils, greases, gels, oil-soluble polymer composition, vegetable oils, and combinations thereof.

10. The lubricant composition of claim 8, wherein the neat fluid is a synthetic petroleum oil selected from the group consisting of polyalphaolefins, polyol esters, and combinations thereof.

11. The lubricant composition of claim 8, wherein said neat fluid comprises a substance selected from the group consisting of pentaerythritol ester, trimethylolpropane ester, neopentyl glycol ester and combinations thereof.

12. The lubricant composition of claim 8, further comprising a thickener to make a grease composition.

13. The lubricant composition as recited in claim 8, wherein said nano graphene platelets have an average thickness less than 10 nm.

14. The lubricant composition as recited in claim 8, wherein said nano graphene platelets have an average thickness less than 1 nm.

15. The lubricant composition as recited in claim 8, wherein said nano graphene platelets comprise single-layer graphene.

16. The lubricant composition as recited in claim 8, wherein the nano graphene platelets have a thermal conductivity of no less than 500 W/m K.

17. The lubricant composition as recited in claim 8, wherein the nano graphene platelets have a thermal conductivity of no less than 1,000 W/m K.

18. The lubricant composition as recited in claim 8, wherein the nano graphene platelets have a thermal conductivity greater than 3,000 W/m K.

19. The lubricant composition as recited in claim 8, wherein the dispersing agent comprises an anionic surfactant.

20. The lubricant composition as recited in claim 8, wherein the dispersing agent comprises a surfactant selected from the group consisting of a sulfonate surfactant, a sulfosuccinate, a sulfosuccinamate, dioctyl sulfosuccinate, bistridecyl sulfosuccinate, di(1,3-di-methylbutyl) sulfosuccinate, and combinations thereof.

21. The lubricant composition as recited in claim 8, wherein the composition has a thermal conductivity greater than 1.0 W/m K.

22. The lubricant composition as recited in claim 8, wherein the composition has a thermal conductivity greater than 10 W/m K.

23. The lubricant composition as recited in claim 8, wherein the composition has a thermal conductivity greater than 30 W/m K.

24. The lubricant composition of claim 8, wherein said neat fluid is selected from the group consisting of Group I (solvent refined mineral oils), Group II (hydrocracked mineral oils), Group III (severely hydrocracked hydrogenated oils), Group IV (polyalphaolefins), Group VI (esters, naphthenes, and polyalkylglycols), and combinations thereof.

25. The lubricant composition of claim 8, wherein said neat fluid is selected from the group consisting of synthetic hydrocarbon oils, halo-substituted hydrocarbon oils, polymerized and interpolymerized olefins, polybutylenes, polypropylenes, propylene-isobutylene copolymers, chlorinated polybutylenes, poly(1-octenes), poly(1-decenes), alkylbenzenes, dodecylbenzenes, tetradecylbenzenes, dinonylbenzenes, di-(2-ethylhexyl)benzenes, polyphenyls, biphenyls, terphenyls, alkylated polyphenyls, alkylated diphenyl, ethers, alkylated diphenyl sulfides, and combinations thereof.

26. The lubricant composition of claim 8, wherein said neat fluid is selected from the group consisting of the esters of dicarboxylic acids selected from the group consisting of phtalic acid, succinic acid, alkyl succinic acids and alkenyl succinic acids, maleic acid, azelaic acid, suberic acid, sebacic acid, fumaric acid, adipic acid, alkenyl malonic acids, with an alcohols selected from the group consisting of butyl alcohol, hexyl alcohol, dodecyl alcohol, 2-ethylhexyl alcohol, ethylene glycol diethylene glycol monoether, propylene glycol, dibutyl adipate, di(2-ethylhexyl) sebacate, di-hexyl fumarate, dioctyl sebacate, diisooctyl azelate, diisodecyl azealate, dioctyl phthalate, didecyl phthalate, dicicosyl sebacate, the 2-ethylhexyl diester of linoleic acid dimer, the complex ester formed by reacting one mole of sebacic acid with two moles of tetraethylene glycol and two moles of 2-ethylhexanoic acid, and combinations thereof.

27. The lubricant composition of claim 8, wherein said neat fluid is selected from the group consisting of esters made from $C_5$ to $C_{12}$ monocarboxylic acids and polyols and polyol ethers such as neopentyl glycol, trimethylolpropane, pentaerythritol, dipentaerythritol, tripentaerythritol, and combinations thereof.

28. The lubricant composition of claim 8, wherein said neat fluid is selected from the group of synthetic based oil ester additives consisting of polyolesters, diesters, di-aliphatic diesters of alkyl carboxylic acids, di-2-ethylhexylazelate, di-isodecyladipate, di-tridecyladipate, and combinations thereof.

29. The lubricant composition of claim 8, wherein said neat fluid is selected from the water-soluble group consisting of an alcohol and its derivatives.

30. The lubricant composition of claim 8, wherein said neat fluid is selected from the water-soluble group consisting of an ethylene glycol, a propylene glycol, a methyl alcohol, an ethyl alcohol, a propyl alcohol, an isopropyl alcohol, and combinations thereof.

31. The lubricant composition of claim 8, wherein said dispersing agent is selected from the group consisting of an lipophilic hydrocarbon group, and a polar functional hydrophilic group consisting of the class of carboxylate, ester, amine, amide, imine, imide, hydroxyl, ether, epoxide, phosphorus, ester carboxyl, anhydride, or nitrile.

32. The lubricant composition of claim 8, wherein said dispersing agent is an ashless dispersant selected from the group consisting of N-substituted polyisobutenyl succinimides and succinates, allkyl methacrylate-vinyl pyrrolidinone copolymers, alkyl methacrylate-dialkylaminoethyl methacrylate copolymers, alkylmethacrylate-polyethylene glycol methacrylate copolymers, and polystearamides.

33. The lubricant composition of claim 8 further comprising a carbon nanotube or a graphite nano particle.

34. A lubricant composition having improved lubricant properties, comprising a lubricating fluid and at least a single-layer graphene sheet.

35. The lubricant composition of claim 34 wherein the composition comprise a plurality of single-layer graphene sheets.

* * * * *